US006643958B1

(12) United States Patent
Krejci

(10) Patent No.: US 6,643,958 B1
(45) Date of Patent: Nov. 11, 2003

(54) SNOW THROWING SHOVEL DEVICE

(76) Inventor: Raymond E. Krejci, 802 Dwight St., Lead, SD (US) 57754

( * ) Notice: Subject to any disclaimer, the term of this patent is extended or adjusted under 35 U.S.C. 154(b) by 0 days.

(21) Appl. No.: 10/139,784

(22) Filed: May 7, 2002

(51) Int. Cl.[7] ..... E01H 4/00; E01H 5/02; E01H 5/09

(52) U.S. Cl. ..... 37/223; 37/239; 37/265; 37/285; 37/250

(58) Field of Search ..... 37/222, 223, 237, 37/238, 239, 240, 265, 260, 262, 285, 248, 249, 250, 251, 252, 230

(56) References Cited

U.S. PATENT DOCUMENTS

| | | | | | |
|---|---|---|---|---|---|
| 2,353,094 | A | * | 7/1944 | Veneziano | 37/245 |
| 2,533,886 | A | * | 12/1950 | Hill | 198/659 |
| 2,692,445 | A | * | 10/1954 | Darnell | 37/251 |
| 3,021,620 | A | * | 2/1962 | Rosenthal | 37/254 |
| 3,115,715 | A | * | 12/1963 | Baldwin | 37/254 |
| 3,199,235 | A | * | 8/1965 | Stacey | 37/259 |
| 3,200,519 | A | * | 8/1965 | Kennedy | 37/246 |
| 3,435,545 | A | * | 4/1969 | Anderson | 37/223 |
| 3,512,279 | A | * | 5/1970 | Benson | 37/244 |
| 4,190,972 | A | * | 3/1980 | Berner | 37/246 |
| 4,255,880 | A | * | 3/1981 | McMickle et al. | 37/259 |
| 4,295,285 | A | * | 10/1981 | Stevens | 37/246 |
| 4,329,792 | A | * | 5/1982 | Berner | 37/246 |
| 4,377,044 | A | * | 3/1983 | Krug | 37/245 |
| 4,651,452 | A | * | 3/1987 | Husso | 37/225 |
| 5,127,174 | A | * | 7/1992 | Takeshita | 37/250 |
| 5,522,162 | A | * | 6/1996 | Allison | 37/242 |
| 5,603,173 | A | * | 2/1997 | Brazell | 37/244 |

* cited by examiner

*Primary Examiner*—Robert E. Pezzuto
*Assistant Examiner*—Thomas A. Beach

(57) ABSTRACT

A snow throwing shovel device for easily removing snow from narrow sidewalks and from steps where a conventional snow blower cannot be used. The snow throwing shovel device includes a scoop assembly including a housing having top, bottom, side, and back walls, and also having an open front; and also includes an elongate chute being attached to the scoop member and through which snow is moved; and also includes a discharge spout being rotatably mounted to the elongate chute; and further includes handle members being attached to the elongate chute; and also includes an assembly of picking up snow and moving snow through the elongate chute.

10 Claims, 3 Drawing Sheets

SNOW THROWING SHOVEL DEVICE

BACKGROUND OF THE INVENTION

1. Field of the Invention

The present invention relates to snow-throwing shovels and more particularly pertains to a new snow throwing shovel device for easily removing snow from narrow sidewalks and from steps where a conventional snow blower cannot be used.

2. Description of the Prior Art

The use of snow-throwing shovels is known in the prior art. More specifically, snow-throwing shovels heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,522,162; U.S. Pat. No. 4,329,792; U.S. Pat. No. 5,603,173; U.S. Pat. No. 4,190,972; U.S. Pat. No. 3,200,519; and U.S. Pat. No. Des. 324,524.

While these devices fulfill their respective, particular objectives and requirements, the aforementioned patents do not disclose a new snow throwing shovel device. The prior art shows shovel-like inventions having a scoop member where the snow is thrown forward of the scoop.

SUMMARY OF THE INVENTION

The general purpose of the present invention, which will be described subsequently in greater detail, is to provide a new snow throwing shovel device which has many of the advantages of the snow-throwing shovels mentioned heretofore and many novel features that result in a new snow throwing shovel device which is not anticipated, rendered obvious, suggested, or even implied by any of the prior art snow-throwing shovels, either alone or in any combination thereof. The present invention includes a scoop assembly including a housing having top, bottom, side, and back walls, and also having an open front; and also includes an elongate chute being attached to the scoop member and through which snow is moved; and also includes a discharge spout being rotatably mounted to the elongate chute; and further includes handle members being attached to the elongate chute; and also includes an assembly of picking up snow and moving snow through the elongate chute. None of the prior art describes an elongate chute and an auger disposed in the elongate chute for throwing snow away from the scoop member.

There has thus been outlined, rather broadly, the more important features of the snow throwing shovel device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new snow throwing shovel device which has many of the advantages of the snow-throwing shovels mentioned heretofore and many novel features that result in a new snow throwing shovel device which is not anticipated, rendered obvious, suggested, or even implied by any of the prior art snow-throwing shovels, either alone or in any combination thereof.

Still another object of the present invention is to provide a new snow throwing shovel device for easily removing snow from narrow sidewalks and from steps where a conventional snow blower cannot be used.

Still yet another object of the present invention is to provide a new snow throwing shovel device that is lightweight and easy and convenient to use.

Even still another object of the present invention is to provide a new snow throwing shovel device that prevents injuries to one's back and possibly any heart attacks due to the stress of removing snow from steps and narrow sidewalks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
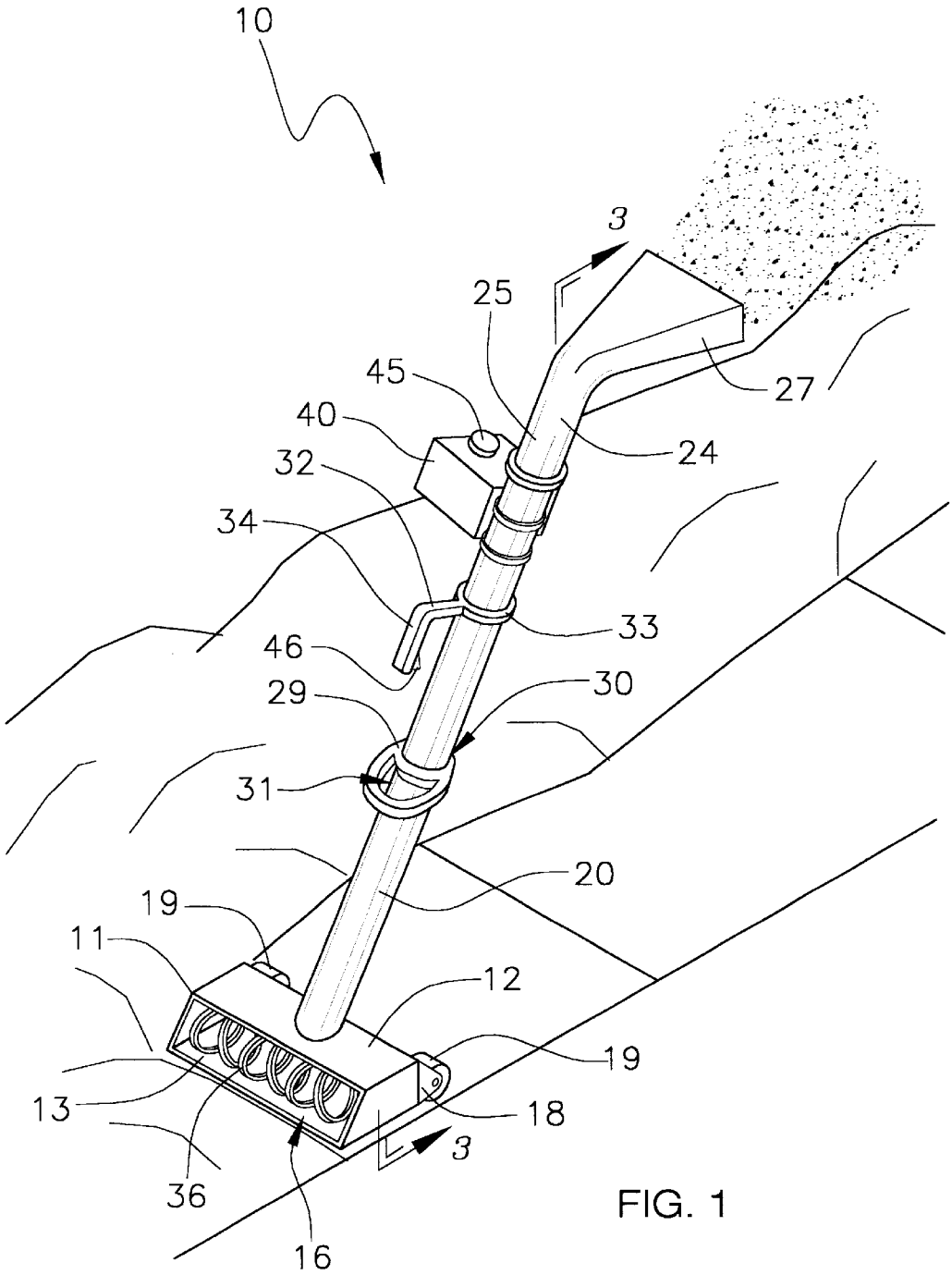
FIG. 1 is a perspective view of a new snow throwing shovel device according to the present invention.
Figure 2:
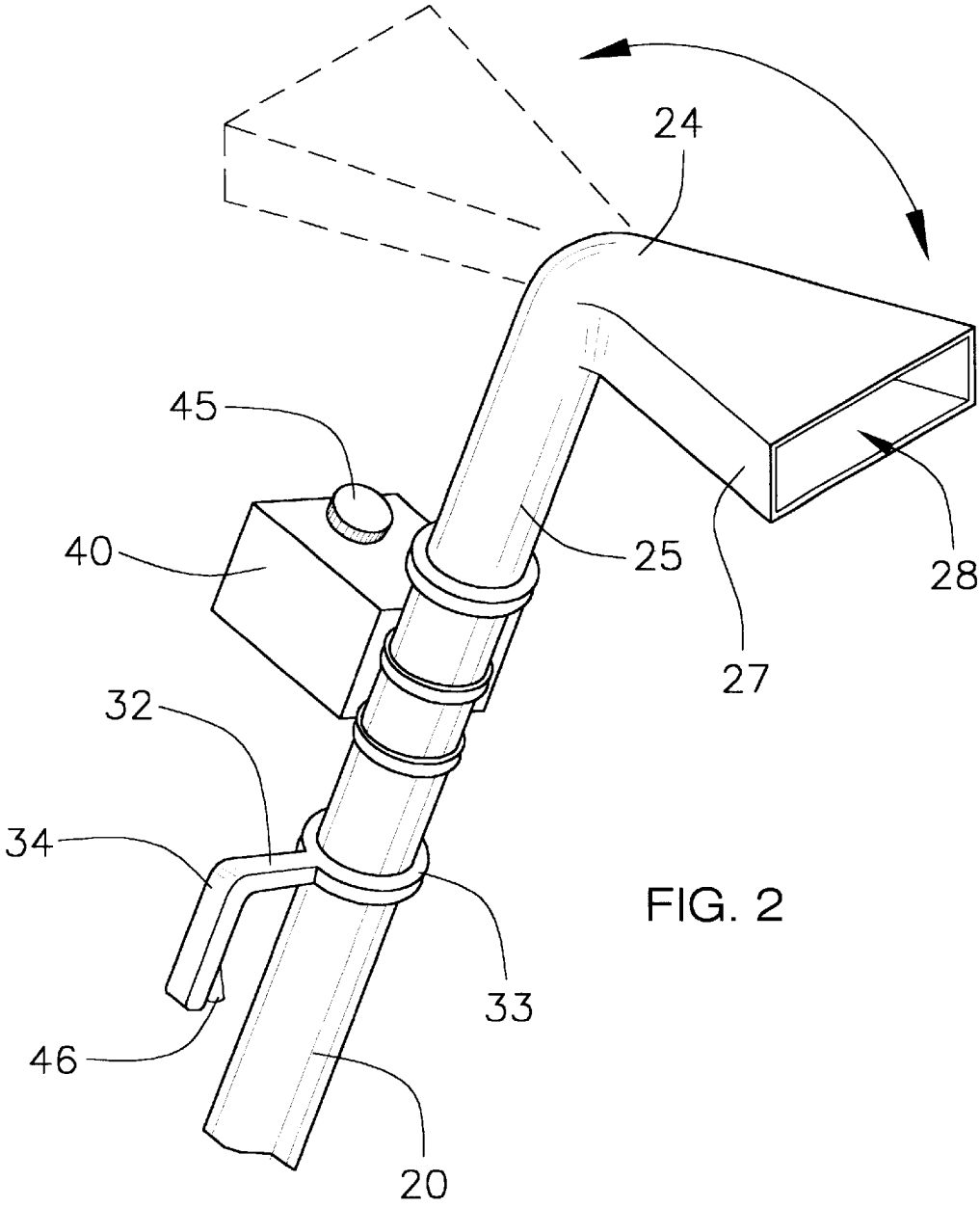
FIG. 2 is a partial perspective view of the present invention.
Figure 3:
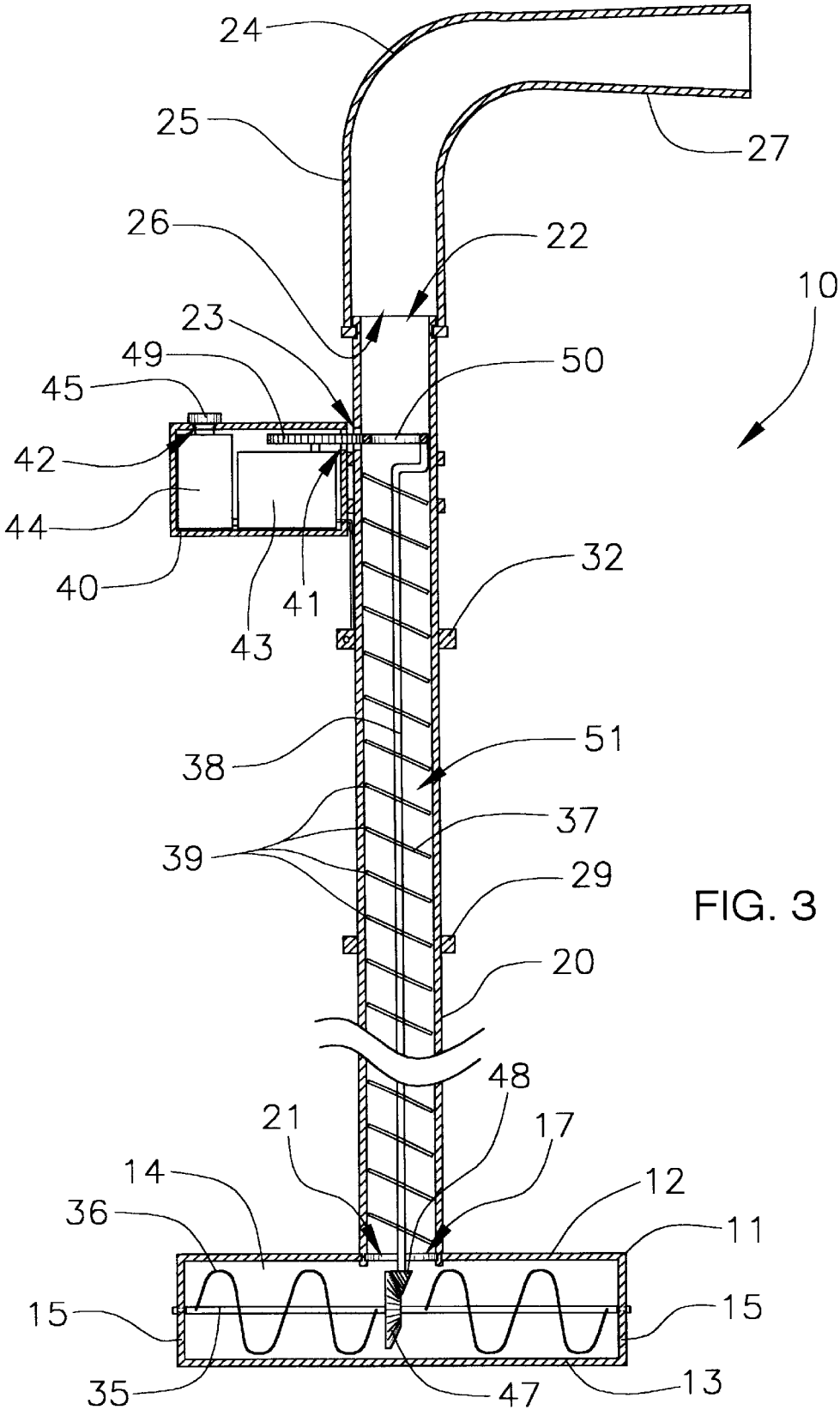
FIG. 3 is a cross-sectional view of the present invention.

With reference now to the drawings, and in particular to FIGS. 1 through 3 thereof, a new snow throwing shovel device embodying the principles and concepts of the present invention and generally designated by the reference numeral 10 will be described.

As best illustrated in FIGS. 1 through 3, the snow throwing shovel device 10 generally comprises a scoop assembly including a housing 11 having top, bottom, side, and back walls 12–15, and also having an open front 16. The housing 11 also includes a hole 17 being disposed through the top wall 12 thereof. The scoop assembly also includes wheel support members 18 being conventionally attached to an exterior of the back wall 14 of the housing 11, and further includes wheels 19 being rotatably and conventionally mounted to the wheel support members 18 for moving the snow throwing shovel device 10 upon a ground.

An elongate chute 20 is conventionally attached to the scoop assembly and through which snow is moved. The elongate chute 20 is an elongate tubular member having open first and second ends 21–22, and also having a bore 51 being disposed therethrough with the first end 21 being securely and conventionally disposed in the hole 17 of the housing 11. The elongate tubular member also has an opening 23 being disposed through a side wall and near the second end 22 thereof.

A discharge spout 24 is rotatably mounted to the elongate chute 20. The discharge spout 24 has a bore 28 extending therethrough, and also has a tubular portion 25 which has an open end 26 which is rotatably mounted upon the second end 22 of the elongate chute 20, and further has a flared discharge portion 27 which is angled relative to the tubular portion 25 and through which snow is discharged.

Handle members 29,32 are conventionally attached to the elongate chute 20. The handle members 29,32 include a first handle member 29 being generally an oblong disc-shaped member having a hole 30 being disposed therethrough and through which the elongate chute 20 is disposed, and also having a hand-hold opening 31 being disposed therethrough for assisting a user to hold onto the first handle member 29. The handle members 29,32 also include a second handle member 32 being conventionally mounted about the elongate chute 20 between the second end 22 of the elongate chute 20 and the first handle member 29. The second handle member 32 has a ring portion 33 and an angled finger portion 34.

A means of picking up snow and moving snow through the elongate chute 20 includes an elongate reel support member 35 being disposed in the housing 11 and having ends which are rotatably mounted to the side walls 15 of the housing 11, and also includes a reel member 36 being conventionally mounted about the elongate reel support member 35, and further includes an auger 37 being rotatably disposed in the bore 51 of the elongate chute 20 and extending substantially a length of the elongate chute 20 and being engagable to the reel member 36 with gear members 47–50, and also includes a housing member 40 being conventionally mounted over the opening 23 of the elongate chute 20, and further includes a motor 43 being disposed in the housing member 40 and being connected to the auger 37 with gears 49,50, and also includes a fuel reservoir 44 being disposed in the housing member 40 and being connected to the motor 43 for providing fuel to energize the motor 43, and further includes a trigger-like switch 46 being conventionally and depressibly mounted to the angled finger portion 34 of the second handle member 32 and being conventionally connected to the motor 43 for the energizing thereof. The reel member 36 is a helical-shaped bar member. The auger 37 includes an elongate shaft 38 and flighting members 39 being conventionally attached about the elongate shaft 38. The gear members 47–50 include a first gear member 47 which is conventionally mounted about the elongate reel support member 35, and also includes a second gear member 48 being conventionally attached at a first end of the elongate shaft 38 of the auger 37 and being engaged to the first gear member 47. The housing member 40 has a first opening 41 being disposed through a side wall thereof, and also has a second opening 42 being disposed through a top wall thereof. The gears 49–50 includes a drive gear 49 being conventionally mounted to a shaft of the motor 43 and being disposed in the housing member 40 and being partially disposed through the first opening 41 of the housing member 40 and through the opening 23 of the elongate chute 20, and also includes a ring gear 50 being conventionally mounted to a second end of the elongate shaft 38 of the auger 37 and being engaged to the drive gear 49. The fuel reservoir 44,45 includes a container 44 having a neck portion which is extended through the second opening 42 of the housing member 40, and also includes a cap member 45 which is removably disposed over an opening into the container 44.

In use, the user energizes the motor 43 which actuates the auger 37 and the reel member 36, and the user moves the scoop assembly upon a ground with the reel member 36 moving the snow up to the auger 37 which moves the snow through the bore 51 of the elongate chute 20 and out of the discharge spout 24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the snow throwing shovel device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A snow throwing shovel device comprising:

a scoop assembly including a housing having top, bottom, side, and back walls, and also having an open front, said housing also including a hole being disposed through said top wall thereof, said scoop assembly also including wheel support members being attached to an exterior of said back wall of said housing, and further including wheels being rotatably mounted to said wheel support members for moving said snow throwing shovel device upon a ground;

an elongate chute being attached to said scoop assembly and through which snow is moved, said elongate chute being an elongate tubular member having open first and second ends, and also having a bore disposed therethrough, said first end being securely disposed in said hole of said housing, said elongate tubular member also having an opening being disposed through a side wall and near said second end thereof;

a discharge spout being rotatable mounted to said elongate chute, said discharge spout having a bore extending therethrough, and also having a tubular portion which has an open end which is rotatably mounted upon said second end of said elongate chute, and further having a flared discharge portion which is angled relative to said tubular portion and through which snow is discharged;

a handle member being attached to said elongate chute; and a means of picking up snow and moving snow through said elongate chute.

2. A snow throwing shovel device as described in claim 1, wherein said handle members include a first handle member being generally an oblong disc-shaped member having a hole being disposed therethrough and through which said elongate chute is disposed, and also having a hand-hold opening being disposed therethrough for assisting a user to hold onto said first handle member, said handle members also including a second handle member being mounted about said elongate chute between said second end of said elongate chute and said first handle member.

3. A snow throwing shovel device as described in claim 2, wherein said second handle member has a ring portion and an angled finger portion.

4. A snow throwing shovel device as described in claim 3, wherein said means of picking up snow and moving snow through said elongate chute includes an elongate reel support member being disposed in said housing and having ends which are rotatably mounted to said side walls of said housing, and also includes a reel member being mounted about said elongate reel support member, and further includes an auger being rotatably disposed in said bore of said elongate chute and extending substantially a length of said elongate chute and being engagable to said reel member with gear members, and also includes a housing member being mounted over said opening of said elongate chute, and further includes a motor being disposed in said housing member being connected to said auger with gears, and also includes fuel reservoir being disposed in said housing member for providing fuel to energize said motor, and further includes a trigger-like switch being mounted to said angled finger portion of said second handle member and being connected to said motor for the energizing thereof.

5. A snow throwing shovel device as described in claim 4, wherein said reel member is a helical-shaped bar member.

6. A snow throwing shovel device as described in claim 4, wherein said auger includes an elongate shaft and flighting members being attached about said elongate shaft.

7. A snow throwing shovel device as described in claim 6, wherein said gear members includes a first gear member which is mounted about said elongate reel support member, and also includes a second gear member being attached at a first end of said elongate shaft of said auger and being engaged to said first gear member.

8. A snow throwing shovel device as described in claim 4, wherein said housing member has a first opening being disposed through a side wall thereof, and also has a second opening being disposed through a top wall thereof.

9. A snow throwing shovel device as described in claim 7, wherein said gears includes a drive gear being mounted to a shaft of said motor and being disposed in said housing member and being partially disposed through said first opening of said housing member and through said opening of said elongate chute, and also includes a ring gear being mounted to a second end of said elongate shaft of said auger and being engaged to said drive gear.

10. A snow throwing shovel device as described in claim 7, wherein said fuel reservoir includes a container having a neck portion which is extended through said second opening of said housing member, and also includes a cap member which is removably disposed over an opening into said container.

* * * * *